United States Patent [19]

Ogihara

[11] 4,422,402

[45] Dec. 27, 1983

[54] APPARATUS FOR DETECTING THE REMAINING AMOUNT OF ROLLED PAPER

[75] Inventor: Masato Ogihara, Kanagawa, Japan

[73] Assignee: Ricoh Company, Ltd., Japan

[21] Appl. No.: 236,640

[22] Filed: Feb. 20, 1981

[30] Foreign Application Priority Data

Feb. 20, 1980 [JP] Japan ..... 55-21022[U]

[51] Int. Cl.[3] ..... G08B 7/06; G08B 21/00

[52] U.S. Cl. ..... 111/67 A; 116/204; 116/202; 200/61.15; 340/644; 340/675

[58] Field of Search ..... 116/67 A; 340/675; 335/205; 200/61.15, 61.17, 61.16

[56] References Cited

U.S. PATENT DOCUMENTS

| | | | |
|---|---|---|---|
| 1,378,887 | 5/1921 | Martin | 200/61.16 |
| 1,542,808 | 6/1925 | Adams | 200/61.16 X |
| 3,081,958 | 3/1963 | Kegg | 200/61.16 X |
| 3,201,537 | 8/1965 | Klaffe et al. | 335/205 X |
| 3,249,713 | 5/1966 | Briggs | 335/205 |
| 3,358,199 | 12/1967 | Jones, Jr. | 200/61.17 X |
| 4,204,180 | 5/1980 | Usui et al. | 340/675 X |

*Primary Examiner*—Daniel M. Yasich

*Attorney, Agent, or Firm*—Guy W. Shoup; Gerard F. Dunne

[57] ABSTRACT

An apparatus for detecting the remaining amount of rolled paper, the diameter of which decreases as it is unrolled, comprises a detection lever which is swingable in a manner such that its free end is always in contact with the decreasing outer diameter of the roller paper. The detection lever includes a magnet piece which actuates a magnetism sensor for actuating an alarm device indicating the time for exchanging the roller paper when the diameter of the paper roll decreases to a predetermined diameter.

9 Claims, 5 Drawing Figures

FIG. 1
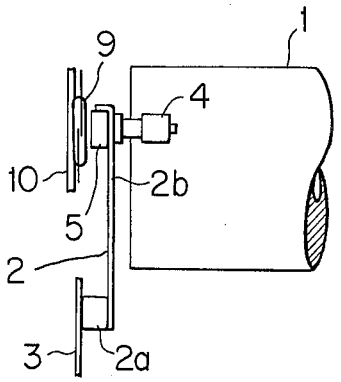
FIG. 2
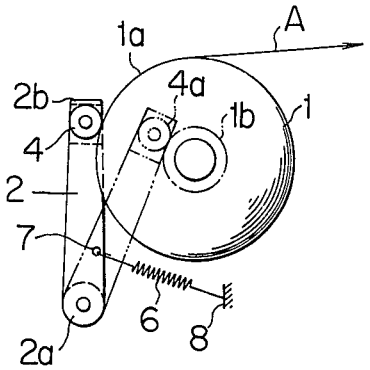
FIG. 3
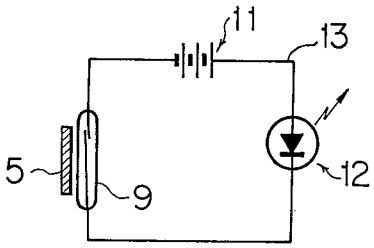
FIG. 4
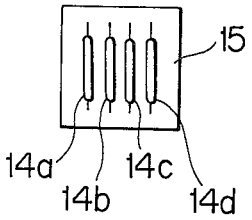
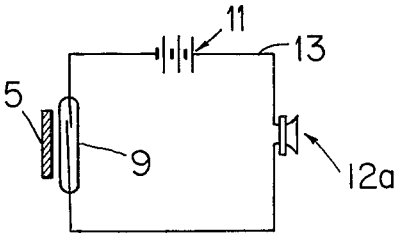
FIG. 5

APPARATUS FOR DETECTING THE REMAINING AMOUNT OF ROLLED PAPER

BACKGROUND OF THE INVENTION

The present invention relates to an apparatus for detecting the amount of the rolled paper remaining in a roll of paper used in a facsimile apparatus, an electrophotographic copying machine or the like.

In a facsimile apparatus employing rolled recording paper or an electrophotographic copying machine employing rolled transfer paper or photosensitized paper, an apparatus for detecting the amount of the remaining paper is required.

Various types of apparatus for detecting the amount of paper remaining on a paper roll have been proposed, and some of these devices are used in practice.

In a facsimile apparatus employing rolled roll at reception of information, and is recording paper roll at each reception of information and is used for the recording of information until the rolled paper comes to an end. For use with such a facsimile apparatus, on apparatus for feeding a new roll of paper or for preventing a shortage of rolled paper during the information reception is known. In such apparatus, the diameter of the paper roll is detected to determine the amount of remaining paper on the principle that the diameter of the paper roll decreases as the paper is consumed. More specifically, in typical apparatus for detecting the amount of rolled paper remaining on a paper roll, a detection member is disposed in contact with a portion on the outer peripheral surface of the paper roll, and the displacement of the detection member is mechanically detected during the operation of the facsimile apparatus. Upon displacement of the detection member to a predetermined position, a warning of a low supply of paper is given by an indicator potion to attract the operator's attention. Alternatively, a detection member is disposed in contact with the outer peripheral surface of paper roll. As the paper is used and the diameter of the paper roll decreases, the detection member moves between a light emitting element and a light receiving element, intercepting the optical path between that two elements and causing some change in electric current flowing in an electric circuit, whereby the remaining amount of the rolled paper is detected and the detected amount is displayed, or an alarm indicating the remaining amount of the paper is low is given to the operator.

The first-mentioned mechanical detection system will work well when the detection member and the indicator portion are located relatively close to each other. However, when the two portions are located relatively far apart from each other, a complicated mechanism for connecting the two portions will be required. That requirement can be a drawback of the mechanical detection system.

In contrast with this, the second-mentioned detection system employing a light emitting element and a light receiving element will present little problems even if the remaining amount detecting portion and the remaining amount indicating portion (or alarm portion) are located far apart. However, the components required for that system are relatively expensive. Furthermore, it is required that the system be strictly protected from dust, since that system is vulnerable to dust which may be deposited on any of the light elements making accurate light measurement difficult, causing malfunction of the system.

SUMMARY OF THE INVENTION

It is therefore an object of the invention to provide an apparatus for detecting the amount of the rolled paper remaining on a paper roll, from which various shortcomings of the conventional apparatus have been successively eliminated, and which apparatus is capable of detecting the remaining amount of rolled paper accurately even if the remaining amount detection portion and remaining amount indicating portion are located far apart, and is not affected by dust.

That object of the invention is attained by an apparatus comprising a paper roll whose diameter decreases as it is unrolled, a detection lever, which is swingable and a free end of which is urged in such a direction that it is brought into contact with the outer peripheral surface of the paper roll. A magnet is attached to the detection lever, and at least one magnetism sensor which is disposed at a position adjacent the path of movement of the magnet when the diameter of the paper roll decreases to a predetermined diameter, and an alarm is activated when the magnet approaches the magnetism sensor.

The detection system according to the invention employs a simple combination of the magnet and the magnetism sensor and is not affected by dust, so that secure detection of the remaining amount of rolled paper can be guaranteed. Since there is no problem if the remaining amount detecting portion and the remaining amount indicating portion are located far apart in this system, the remaining amount indicating portion can be disposed at the desired place. Further, this system is very inexpensive due to its simple construction.

If the system is constructed so as to be capable of indicating the remaining amount of the rolled paper in different stages by use of plural magnetism sensors, it will be very useful, in particular, for facsimile apparatus. In the case of a copying machine, the operator usually attends to the machine in operation and can supply a new paper roll on the spot when necessary in accordance with a remaining amount indicating signal. However, in the case of a facsimile apparatus, the operator is not always present during operation of the apparatus. Therefore, in the facsimile apparatus, it is necessary to hold a sufficient amount of paper above a predetermined amount at any time, in particular for unattended continuous information reception or for night reception. In this case, plural magnetism sensors serve not only to detect the end of a paper roll but also to detect the remaining amount of the rolled paper in stages. If the remaining amount of the rolled paper is known, a sufficient amount of rolled paper can be set beforehand, for instance, for night reception, preventing any trouble caused by a shortage of the rolled paper.

BRIEF DESCRIPTION OF THE DRAWINGS

FIG. 1 is a front view schematically illustrating an embodiment of an apparatus for detecting the remaining amount of rolled paper according to the invention.

FIG. 2 is a side view of the apparatus in FIG. 1.

FIG. 3 is a circuit diagram for the apparatus in FIG. 1.

FIG. 4 is a schematic illustration of a magnetism sensor which is different from the magnetism sensor employed in the embodiment shown in FIG. 1.

FIG. 5 is another circuit diagram for the apparatus in FIG. 1.

DETAILED DESCRIPTION OF THE PREFERRED EMBODIMENT

Referring to FIGS. 1 and 2, there are respectively shown a front view of part of an apparatus for detecting the remaining amount of rolled paper according to the invention and a side view of the same. In FIGS. 1 and 2, the rolled paper 1 is unrolled in the direction of the arrow A, so that the outer diameter 1*a* of the paper roll decreases to a diameter 1*b* which is shown by the alternate long-and-short dash line in FIG. 2. A detection lever 2 includes a cylindrical base end portion 2*a* through which the detection lever 2 is pivotally mounted on a support plate 3 which may form part of a copying machine, facsimile machine, or the like as will be well understood by those skilled in the art. The detection lever 2 further includes a free end portion. On the free end portion 2*b* of the detection lever 2 is mounted a rotatable roller 4. To the free end portion 2*b* the detection lever 2 and of on the side opposite to the rotatable roller 4, there is fixed a permanent magnet 5. One end of a spring 6 is held in a hole 7 formed in an appropriate position of the detection lever 2, while the other end of the spring 6 is fixed to an immovable bracket 8 fixed inside the copying machine, facsimile machine or the like, whereby the roller 4 is urged in a direction such that it is always in pressure contact with the outer peripheral surface of the paper roll.

A magnetism sensor 9 is a switch which closes its contacts upon sensing magnetism. The sensor 9 is attached to a support plate 10 of the copying machine, facsimile machine or the like at a position such that the sensor 9 is located across from the magnet 5 with a small gap therebetween when the roller 4 comes into pressure contact with the small diameter portion 1*b* in accordance with the decrease in the amount of rolled paper. The sensor 9 is disposed parallel to one end surface of the paper roll 1. An alarm, such as the light emitting diode 12 of FIG. 3, comprises an indication lamp disposed in an operation panel, which is lit when the sensor 9 closes its contacts. An alarm device which generates a warning sound to attract the operator's attention may also be provided. An example of an electric circuit which is connected to a power source and an indication lamp 12 is shown in FIG. 3, and such a circuit using a sonic alarm device 12*a* is shown in FIG. 5. In the electric circuits, the voltage of a power source 11 is applied to the light emitting diode 12 or sonic emitter 12*a* through a circuit 13 when the magent 5 is brought close to the sensor 9 and its switch is closed.

Therefore, when there is a sufficient amount of paper in the roll 1, the detection lever 2 is located at a position shown by the solid line in FIG. 2. When the detection lever 2 is located at that position, the sensor 9 and the magnet 5 are located sufficiently apart from each other that the indication lamp is not lit, and no alarm is given. However, when the paper roll is unrolled, decreasing its diameter, and the detection lever 2 comes to a position shown by the alternate long-and-short line, the magnet 5 enters the magnetism sensing area of the magnetism sensor 9, so that the switch of the sensor 9 is closed. When the switch of the sensor 9 is closed, the voltage of the power source is applied to the indication lamp or to the alarm, so that the indication lamp is lit, or the alarm gives a warning sound to the operator, indicating the time for exchanging the paper roll with a new one.

In the present embodiment, a single magnetism sensor is employed for detecting the remaining amount of the rolled paper and, at the same time, indicating the timing for exchanging the paper roll with a new one. However, the invention is not limited to the use of a single magnetism sensor, but plural magnetism sensors can be employed. More specifically, in the path of the magnet 5 which is moved in accordance with the decrease in diameter of the paper roll, a printed circuit board 15 including plural reed switches such as 14*a*, 14*b*, 14*c* and 14*d* as shown in FIG. 4 is disposed. In this detecting apparatus, those reed switches are successively operated as the detection lever 2 (FIG. 2) is moved and the remainder of the rolled paper decreases. In accordance with the detected diameter of the paper roll, the output of each reed switch is applied to the corresponding light emitting diode 12, so that the corresponding light is lit, or the display lamp is lit with a different color depending upon the diameter of the paper roll.

What is claimed is:

1. An apparatus for detecting the remaining amount of rolled paper, comprising:

a roll of paper, the diameter of which decreases as it is unrolled, a swingable detection biased lever having a free end and a fixed end, the fixed end mounted on a support plate in said apparatus, said lever lying along the side of the roll of paper and said lever adapted to move in a plane parallel to the side of the roll of paper, and elongated contact means having a roller connected to said free end of said lever and urged into contact with the outer peripheral surface of said roll of paper, a magnet piece attached to said free end of said detection lever, at least one magnetism sensor mounted on a support plate in said apparatus and disposed at such a position that the sensor is activated by said magnet piece when said swingable detection lever with said magnet piece comes to a predetermined position relative to said sensor as the diameter of said rolled paper decreases to a predetermined diameter, and alarm indicating means activated in accordance with the activation of said magnetism sensor.

2. An apparatus for detecting the remaining amount of rolled paper as in claim 1, wherein said contact means is urged by spring means.

3. An apparatus for detecting the remaining amount of rolled paper as in claim 1, wherein said alarm means is an alarm device capable of generating alarm sound.

4. An apparatus for detecting the remaining amount of rolled paper as in claim 1, wherein said magnet piece is a permanent magnet.

5. An apparatus for detecting the remaining amount of rolled paper as in claim 1, wherein said magnetism sensor is disposed parallel to one end surface of said rolled paper.

6. An apparatus for detecting the remaining amount of rolled paper as in claim 1, further comprising means including a plurality of magnetism sensors spaced along a path generally parallel to the side of said roll of paper for indicating various amounts of rolled paper remaining on said roll of paper.

7. An apparatus for detecting the remaining amount of rolled paper as in claim 6, including a plurality of said alarm means corresponding in number to the number of said magnetism sensors.

8. An apparatus for detecting the remaining amount of rolled paper as in claim 7, wherein said alarm means comprises a plurality of indication lamps, each having a different color.

9. An apparatus for detecting the remaining amount of rolled paper as in claim 1, wherein said alarm means is a display lamp.

* * * * *